US005718826A

United States Patent [19]

Frejborg

[11] Patent Number: 5,718,826

[45] Date of Patent: Feb. 17, 1998

[54] SCREEN AND METHOD OF MANUFACTURE

[75] Inventor: Frey A. Frejborg, Queensbury, N.Y.

[73] Assignee: CAE Screen Plates, Inc., Pruyn's Island, N.Y.

[21] Appl. No.: 451,349

[22] Filed: May 26, 1995

[51] Int. Cl.[6] ..... B01D 33/067

[52] U.S. Cl. ..... 210/402; 210/403; 210/498; 210/499; 29/896.6; 29/896.62

[58] Field of Search ..... 210/402, 403, 210/498, 499; 29/896.6, 896.62

[56] References Cited

U.S. PATENT DOCUMENTS

| | | |
|---|---|---|
| 3,631,981 | 1/1972 | Young . |
| 5,200,072 | 4/1993 | Frejborg et al. . |

FOREIGN PATENT DOCUMENTS

| | | |
|---|---|---|
| 0509909 | 10/1992 | European Pat. Off. . |
| 72627 | 10/1930 | Sweden . |
| WO 93/04797 | 3/1993 | WIPO . |

*Primary Examiner*—W. L. Walker
*Attorney, Agent, or Firm*—Nixon & Vanderhye, P.C.

[57] ABSTRACT

A screen cylinder, screen, method of manufacture of the screen cylinder, and method of use of the screen cylinder, allow screen capacity to be maximized without sacrificing screen cylinder strength, and while achieving a clean accepts flow. A screen cylinder is constructed in a conventional manner except that at least one reinforcing ring is permanently fastened (typically by continuous or spot laser or electric beam welding, or direct resistance welding) to at least a majority of (and typically essentially all of) the land areas which separate grooves in a row from each other, at the outlet surface of the cylinder. The welds each typically have a width of about 1 to 3 mm (that is they are very small), but that width is typically at least about 75% of the width of a land area in which it is formed, and the weld has a length of at least about 50% of the width of the reinforcing ring at the weld. In this way effective slot length of screen cylinders may be about 65–90% of the total screen length, compared to only about 45–55% for conventional screen cylinders. The screen cylinders are particularly effective in screening cellulose pulps from the pulp and paper industry.

25 Claims, 7 Drawing Sheets

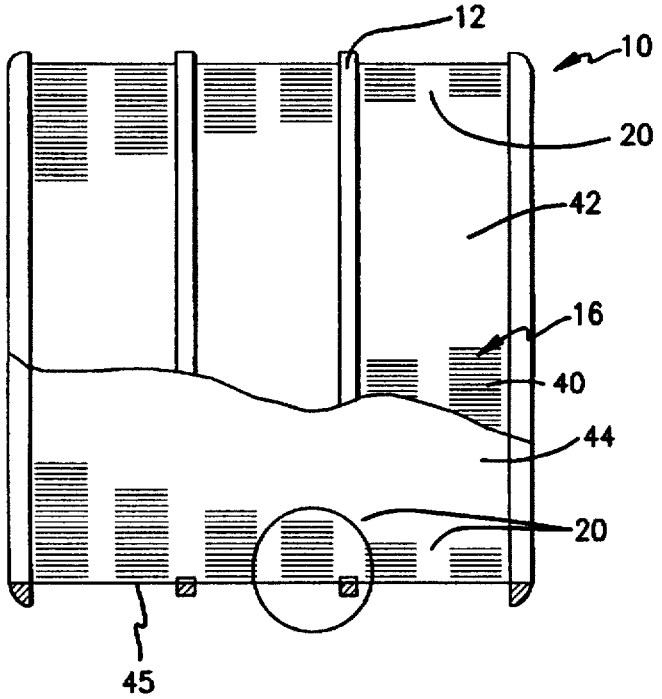
FIG. 9
PRIOR ART
FIG. 10
PRIOR ART
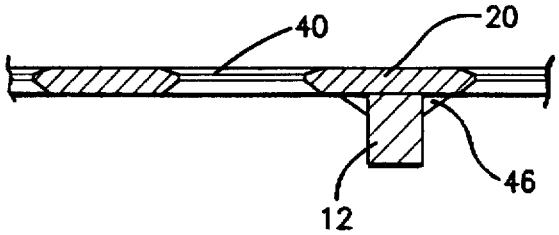
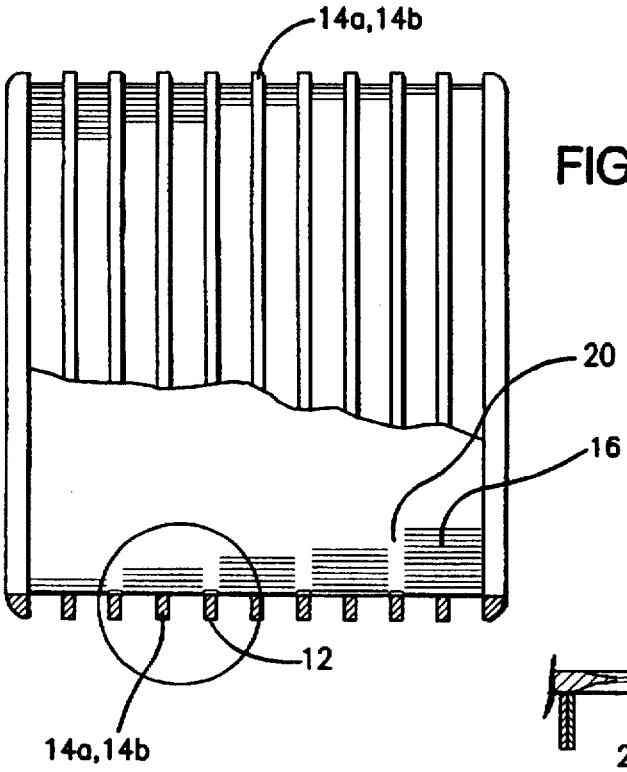
FIG. 11
FIG. 12
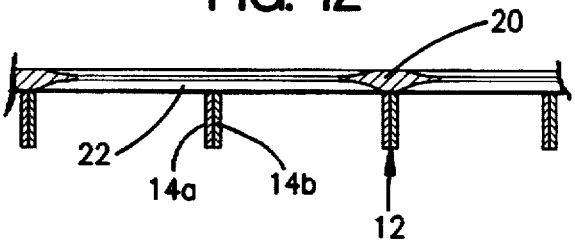

SCREEN AND METHOD OF MANUFACTURE

BACKGROUND AND SUMMARY OF THE INVENTION

The present invention relates to a screen, e.g. a screen with a screen cylinder for screening pulp in pulp and paper industry, a screen cylinder per se, a method of its manufacture, and a method of utilization of a screen cylinder of the invention.

Screening of pulp in the pulp and paper industry is generally performed by using screen cylinders with openings therethrough for separating the accepts and rejects portions of the pulp. In many screen cylinders grooves are provided in the inlet and outlet side surfaces of the screen plate, for adjusting the flow characteristics and improving flow capacity of the screen. Screening openings, i.e. sizing slots, are machined or otherwise made by other methods from either the grooved side or the contour (inlet) side of the screen plate. Two to twelve groups or rows of axially extending grooves are arranged one after the other along the axis of the cylinder. A cylindrical land portion is formed between each neighboring row of grooves.

Rings have in most cases been secured on the outflow side of the screen cylinder in order to compensate for the weaker construction of the grooved cylinder compared to the strength of a blank cylinder. The rings ensure stiffness, rigidity and structural strength of the cylinder. Especially in pressurized screens, rings are needed to ensure rigidity. Rings have been secured to the screen cylinder by welding them circumferentially about the cylinder.

The rings have typically been fastened by welding them to the cylindrical land portions formed between the rows of grooves. The welds have been made by conventional welding techniques to form a protruding welded seam on each side of the ring. It would be very difficult to fasten a ring onto grooved portions of a screen cylinder, i.e. perpendicularly to the grooves on the ridges formed between neighboring parallel grooves, with such conventional welding methods and the results would not be satisfactory. In addition, thick welds (typically 3–6 mm) and especially if applied to screen cylinder surface with grooves have a tendency to cause under cuts in the narrow ridges on the groove side, causing stress-risers with potential for development of fatigue cracks. Thick welded seams would block a substantial number of screening openings in the grooves and thereby decrease the effective open area of the screen and consequently the screening throughput or flow capacity. Thick weldings could also distort the land portions between parallel grooves and slots, which would have a detrimental effect on screening. While the construction of U.S. Pat. No. 5,200,072 (the disclosure of which is hereby incorporated by reference herein) addresses this problem for screen cylinders with long grooves, the above related difficulties with conventional welding and the detrimental effects of the thick welds are still significant for screen cylinders with most conventional length slots and grooves, and are still greater in screens with unusually small slot widths.

In conventional screening cylinders, only a limited percentage of the cylinder area has screening openings, slots or the like. This limits the flow through the screen, i.e. the flow capacity. It is not simply a matter of increasing the number of apertures through the screen plate to compensate for such reduced numbers of screening openings or reduced open area, as predetermined circumferential spacings between openings must usually be maintained. Also structural considerations limit the open area. Further, the aforementioned rings providing structural strength limit the open area of the screen, as the rings have required a considerable land area to be welded to. The land areas which have to be provided for the reinforcement rings at certain axial distances considerably restrict the length of grooves and screening slots.

It is not possible with conventional means to increase the distance between reinforcement rings and land areas significantly from what is conventionally used and thereby increase the length of slots. Slot length is conventionally between 35–65 mm, typically 50 mm. Longer distances between rings would lead to decreased stability and e.g. to slot width continuously changing due to pressure variations induced by foils or rotors used for back pulsing accept suspension. Rotor power applied when inducing positive and negative pulses on the cylinder can exceed 100 $kW/m^2$ and thereby cause high flow acceleration and rapid changes of pressure affecting the surface of the screen cylinder and slots. Undesirable movement of land portions, "land bridges", between slots, due to the above mentioned rotor action causes fatigue.

Slotted screen cylinders have, especially when manufactured with conventional milling tools, a tendency to create sensitive stress-risers at the four comers of the slots. A fast running rotor (25–30 m/s), and its mostly negative pulses creating elements, causes highly aggressive hydrodynamic conditions forcing the cylinder surface to oscillate in a ± mode. The amplitude and frequency of the oscillations can cause the development of fatigue cracks initiating from the earlier mentioned stress risers.

A safe fatigue-cracking problem avoiding screen cylinder design would therefore have to be reinforced with frequent support rings and relatively short grooves/slots for greater stability. Increasing the number of rings or decreasing the length of slots would however decrease the open area, i.e. the flow capacity, of the screen, which of course is undesirable. On the contrary there has long been a need to increase the flow capacity of screens.

There is a general goal of decreasing slot width in screen cylinders, in order to achieve a cleaner accepts flow. This has also been possible to achieve, due to improved flow conditions around slot openings, developed during the last decade. Smaller slot widths lead, however, to decreased open area in the screen. Screens with 0.35 mm slots may have had an open area of about 6%, whereas comparable screens with only 0.1 mm slots have an open area of about 1%–1.5%. This decrease of open area and slot width leads to increased resistance to flow, and accordingly decreased flow capacity. A change from 0.2 mm slots to 0.1 mm slots generally leads to a decrease in open area of about 50%, and a decrease in flow capacity of about 70%.

There has long been a need for screen cylinder structures with increased open slot area, and the above-described changes in slot width further increases this need. To address this need, it has been suggested in U.S. Pat. No. 3,631,981 that contoured reinforcement rings could be welded (e.g. by a single weld) on solid circumferential land areas on the screen cylinder, the rings being contoured around the slots to provide a slight increase in the length of the groove or slot in either end close to the circumferential land area. However, this gives a very small increase in open area, and the attachment mechanism has proven to cause mechanical strength problems with rings cracking in the weld and then falling down, particularly with smaller slots and relatively high consistencies where high kW rotors are used.

Therefore there is a need to provide an improved grooved type screen cylinder with increased open area yet secure mechanical strength properties compared to conventionally fabricated screen cylinders. There is a need to provide a screen with a grooved screen cylinder in which open area and thereby flow capacity can be increased compared to conventional grooved screen cylinders of its kind without decreased cleanliness, and to provide an improved method of manufacturing grooved screen cylinders.

The present invention provides a screen with a grooved screen cylinder, for use in pulp and paper industry, which has substantially increased open area, increased efficiency, increased flow capacity and/or increased strength characteristics compared to prior grooved screen cylinders of its kind. The screen cylinder according to the invention is also simple to manufacture compared to prior art methods of forming such screens.

According to one aspect of the present invention a screen cylinder for screening suspensions to provide an accepts portion and a rejects portion is provided. The screen cylinder comprises the following components: A cylinder having an outer surface, an inner surface, a central axis, and an effective axial length, one of the inner and outer surfaces comprising an outlet side of the cylinder, and the other of the inner and outer surfaces comprising an inlet side of the cylinder. A plurality of grooves substantially parallel to the central axis formed in the outlet surface, disposed in a plurality of rows with a plurality of parallel grooves disposed, in sequence, in each row. A slot provided in at least some of the grooves, defining a through-extending flow path of a predetermined size between the inlet and outlet surfaces. At least some of the plurality of rows separated from each other by a first substantially cylindrical land area. The grooves within a row are separated from each other at the outlet surface by a second land area much smaller than the first land area. At least one first reinforcing ring is fastened to a the first land area for providing stability to the cylinder. And, at least one second reinforcing ring is permanently fastened to at least a majority of the second land areas in at least one row of grooves to provide additional stability to the cylinder without significantly adversely affecting the flow of accepts through the slots.

In many screen cylinders a slot will be provided in all (or substantially all) of the grooves. However cylinders may be constructed in which other openings (e.g. round holes) may be provided in at least some of the grooves.

Depending upon the actual height of the screen cylinder, it may comprise 1–20, typically 4–10, preferably 5–8, axially disposed rows of grooves with a cylindrical land portion between each two neighboring rows of grooves. A second reinforcing ring fastened to a groove area is, according to a preferred embodiment of the present invention, fastened by welding [e.g. continuous laser welding or by spot welding] to the second land areas, between neighboring grooves. Such a ring may, according to another embodiment of the present invention, be fastened by continuous electron beam welding, or spot welded by electron beam, to the second land portions, or by direct resistance welding, fusing each land area between adjacent relief grooves to the reinforcing ring.

Typically each second reinforcing ring is welded to substantially all of the second land areas in one row of grooves by a first weld, each of the first welds having a width of about 1–3 min. Preferably each of the first welds has a width at least about 75% of the width of a second land area on which it is formed, and a length of at least about 50% of the width the second reinforcing ring thereat. Using the reinforcing construction according to the present invention a screen cylinder may be constructed wherein the sum of the axial lengths of slots in a column of grooves extending axially in a straight line along the cylinder divided by the effective length of the cylinder is between about 0.65–0.9 (preferably greater than 0.7 to about 0.8) which compares to prior art ratios of about 0.45–0.55.

In one embodiment of the invention, at least one of the second reinforcing rings (typically at least two rings are provided for a conventional cylinder where the plurality of rows of grooves comprise 4–10 circumferential rows of grooves) comprises a composite ring formed of axially spaced first and second components welded to each other, or a composite ting formed of radially spaced first and second components connected together.

The screen cylinder described above is best suited for screening pulps in the lower consistency range, e.g. between about 0.3–1.5%, and high flow volumes where highly aggressive (high power) rotors actions are not required. However where the consistencies are between about 1.5–6.0%, or otherwise where aggressive rotors are used (that is where the power consumption is above about 30 $kW/m^2$ of cylinder surface area), instead of—or preferably in addition to—the rings described above a metal (e.g. steel) backing support cylinder with large square punched openings can also be provided, e.g. attached to the rings, e.g. by welding.

In some screen cylinders (having staggered slot rows), the circumferential solid land areas are interrupted by grooves (with slots) which bridge them, and are staggered between the normal rows of grooves and slots. In such cylinders the first and second rings used are essentially the same as in the conventional constructions, and have substantially the same spacings between them, the first rings merely have the welds thereof interrupted by the staggered, bridging, grooves.

According to another aspect of the present invention a method of manufacturing a screen cylinder is provided comprising the following steps: (a) Constructing a cylinder having an outer surface, an inner surface, a central axis, and an effective axial length, one of the inner and outer surfaces comprising an outlet side of the cylinder, and the other of the inner and outer surfaces comprising an inlet side of the cylinder, by: (a1) forming in the outlet surface a plurality of grooves substantially parallel to the central axis, disposed in a plurality of rows with a plurality of parallel grooves disposed, in sequence, in each row; and (a2) forming a slot provided in at least some of the grooves, each slot defining a through-extending flow path of a predetermined size between the inlet and outlet surfaces; the forming steps (a1) and (a2) being practiced so that at least some of the plurality of rows are separated from each other by a first substantially cylindrical land area, and so that the grooves within a row are separated from each other at the outlet surface by a second land area much smaller than the first land area. (b) Fastening at least one first reinforcing ring to the screen cylinder at at least one first land area, to provide stability to the screen cylinder. And, (c) fastening at least one second reinforcing ring to at least some of a plurality of the second land areas in at least one row of grooves, to provide additional stability to the cylinder without significantly adversely impacting the flow of accepts through the slots.

Step (c) may be practiced by welding at least one second reinforcing ring to each of substantially all of the second land areas in a row of grooves. The reinforcing ring may be welded to the land portions between the grooves by directing a laser beam e.g. radially through the ring material. The laser beam is then directed through the outer cylindrical side plane of the ring towards a land portion between two grooves. A hidden weld is formed in the contact area between the inner cylindrical side plane of the ring and the respective land portion.

If the radial extension of the ring is large, that is if the ring has an axial extension, e.g. >5 mm [i.e. too big for the laser beam to penetrate], then the laser beam may be directed from either one of the two radially extending side planes of the ring towards the intended welding spot between the inner cylindrical side plane of the ring and a land portion between two grooves. The laser beam then forms an angle <90□, typically about 30□–50□, with the radius of the ring.

Step (c) may be practiced by looping a completely formed metal ring over the cylinder outer surface for an outflow screen cylinder, or inserting a completely formed ring into the hollow interior (and sliding it down) for an inflow type screen cylinder. Alternatively where the screen cylinder is an outflow screen cylinder step (c) may be further practiced by looping a partially formed ring—having free ends—around the outer surface of the screen cylinder, and fastening the free ends of the partially formed ring together while the ring is traversing the second land areas to which it is to be welded. When the screen cylinder is to be used with rotors having a power consumption that is above about 30 $kW/m^2$ of cylinder surface area, step (c) may also be practiced by looped a punched cylindrical shell over the rings, or alternatively be practiced by looping the punched cylindrical shell over the cylinder, in this case the "ring" not being solid, but being the punched cylindrical shell.

The invention also relates to a method of using a screen cylinder to screen cellulose pulp from the pulp and paper industry, the screen cylinder as described above. This method comprises the steps of: (a) Causing the cellulose pulp to flow in a primarily circumferential path along the inlet side surface; and while the pulp is flowing in the substantially circumferential path: (b) causing accepts to pass through the slots to the outlet side surface without the flow thereof significantly adversely impacted by the at least one second reinforcing ring; and (c) causing rejects to pass along the inlet side surface to be moved away from engagement with the screen cylinder. Steps (a)–(c) are typically practiced with the pulp at a consistency of between about 0.3–6.0%, preferably between about 0.3–1.5%. Step (a) may be practiced using a rotor. If the rotor has a power consumption that is above about 30 $kW/m^2$ of cylinder surface area, then the screen cylinder typically further comprises a punched cylinder disposed over, and connected to, the first and second reinforcing rings, providing further reinforcement to the cylinder, and steps (a)–(c) are practiced with pulp at a consistency of between about 1.5–6.0%.

The invention also relates to a screen (such as a pressure screen) for screening pulp. The screen comprises the following components: An inlet for suspension to be screened. An outlet for accepts. An outlet for rejects. A pulsing structure (such as a rotor, especially where the screen cylinder remains stationary); and a screen cylinder, particularly the screen cylinder as specifically described above in which at least one second reinforcing ring is welded to substantially all of the second land areas in at least one row of grooves to provide additional stability to the cylinder, while not significantly adversely impacting the flow of accepts through the slots. And, the screen cylinder is positioned with respect to the outlet so that accepts flow through the slots from the inlet to the accepts outlet, and rejects flow along the inlet surface of the screen cylinder and then ultimately through the rejects outlet.

Each groove formed in a screen cylinder of the present invention may be a groove having a screening slot parallel with the groove, and disposed therein. The slot is preferably disposed substantially in the bottom of the groove, but may be disposed on either of the side planes of the groove. The groove may in some special embodiments be formed by the screening slot itself, if no additional larger relief groove is needed in the screen. The groove may have screening openings of other form than slots disposed therein, such as round holes or oblong openings.

The grooves on the outlet side of the screen cylinder, i.e. the relief grooves, are according to a preferred embodiment of the present invention connected through screening openings, such as slots, to contoured grooves on the inlet side of the screen cylinder, said contoured grooves having an upstream side plane, a bottom and a downstream side plane. The contoured grooves [and the screens utilizing them] may be formed as shown in U.S. Pat. Nos. 4,529,520, 4,836,915, 4,880,540, and/or 5,000,842, the disclosures of which are hereby incorporated by reference herein.

It is the primary object of the present invention to provide a screen cylinder, screen using the screen cylinder, method of use of the screen cylinder, and method of manufacture of the screen cylinder, that allow increased capacity of a screen cylinder without significantly adversely affecting screen strength, and/or enhanced accepts cleanliness. This and other objects of the invention will become clear from an inspection of the detailed description of the invention and from the appended claims.

BRIEF DESCRIPTION OF THE DRAWINGS

FIG. 9 is a side view, partly in cross-section and partly in elevation, of a prior art construction of a screen cylinder;

FIG. 10 is a detail cross-sectional view of the portion of the prior art screen cylinder of FIG. 9 circled in FIG. 9;

FIGS. 11 and 12 are views like those of FIGS. 9 and 10 only for a screen cylinder according to the present invention;

DETAILED DESCRIPTION OF THE DRAWINGS

Figure 1A:
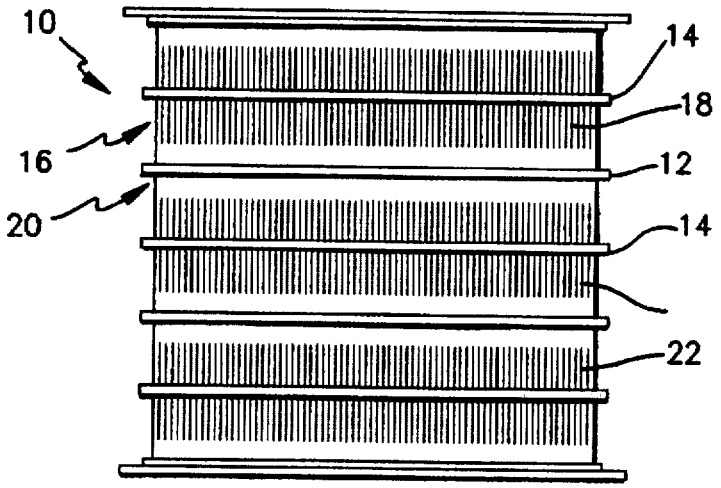
FIG. 1A is a side view of an exemplary screen cylinder according to the present invention.

FIG. 1 shows a metal (e.g. steel) cylindrical screen cylinder 10, with first and second metal (e.g. steel) reinforcing rings 12 and 14, respectively, on its outlet side. The screen cylinder 10 has three separate grooved areas 16 containing rows of grooves, with several axially extending parallel grooves 18 disposed along the circumference of the screen cylinder 10. The grooved areas 16 are separated from each other axially by substantially cylindrical first (relatively large) land portions 20. Each individual groove 18 is separated from adjacent grooves 18 by substantially oblong second (relatively small) land portions 22 parallel to the grooves 18.

Reinforcing rings 12 may be welded in a conventional manner to the land portions 20 between groove areas, or according to the present invention, e.g. by laser welding. Rings 14 are welded according to the present invention to the oblong, second, small land portions 22 in the grooved areas 16. The rings 12, 14 are welded one after the other (preferably in sequence) onto the cylinder 10. Each ring 12, 14 is heated for a light shrink fit, slipped over the cylinder, placed in its proper position and fastened, preferably by welding e.g. laser spot welding, before the next ring 12, 14 is slipped over the cylinder and fastened by welding.

The screen cylinder illustrated in FIG. 1 is a conventional out-flow screen cylinder, which is the most common type. However the invention can be utilized with in-flow screen cylinders equally well. In such a situation the reinforcing rings 12, 14, would be slid into the interior of the screen cylinder, the inner surface thereof then being the outlet side, and properly positioned for fastening. Alternatively for out-flow construction screen cylinders 10, each or some of the rings 12, 14 may be partially formed, and looped around the outer surface of the screen cylinder 10, the free ends of the partially formed ring being brought together and fastened in place (typically by welding) while the ring is traversing the land areas to which it is to be welded.

Figure 1B:
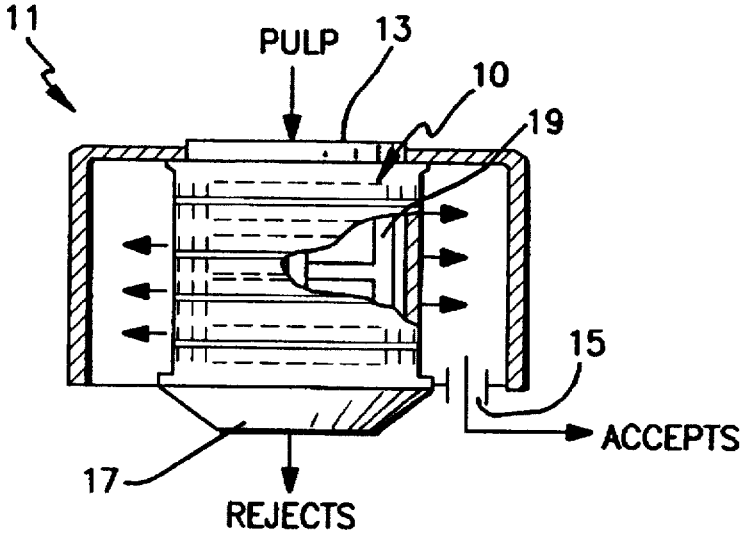
FIG. 1B is a schematic side view, partly in cross-section and partly in elevation, of an exemplary conventional pressure screen utilizing the screen cylinder of FIG. 1A.

FIG. 1B shows a screen cylinder 10 according to the invention schematically in a conventional pressure screen. The pressure screen is illustrated schematically by reference 11, and includes an inlet 13 for suspension (typically cellulose pulp from the pulp and paper industry at varying consistencies, typically between about 0.3%–6%, preferably between about 0.3–1.5% for the embodiment of screen cylinder illustrated in FIGS. 1–3) to be screened. Since the screen cylinder 10 illustrated in the drawings is an out-flow screen cylinder, the inlet 13 is to the interior of the screen cylinder 10. The screen 11 also includes an outlet 15 for accepts, an outlet 17 for rejects, and a pulsing structure for causing the cellulose pulp to flow in a primarily circumferential path along the inlet side surface of the screen cylinder 10. The pulsing structure in this embodiment is shown as a rotor 19. However it is to be understood that any conventional pulsing structure, whether stationary (while the screen cylinder 10 is rotating) or rotating may be provided, and the rotor 14 is only one of many examples of such a pulsing structure.

Figure 2:
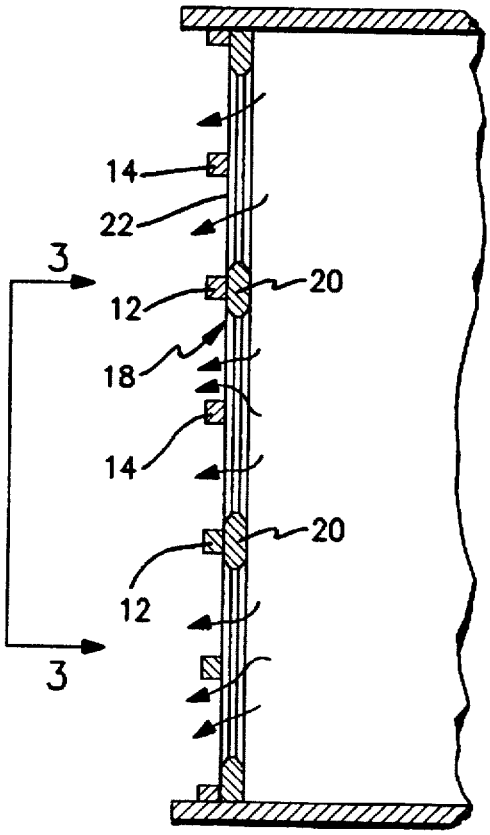
FIG. 2 is a fragmentary elevational cross-sectional view of the screen cylinder seen in FIG. 1A.

FIG. 2, which is a fragmentary elevational sectional view taken axially along a side of the screen cylinder shown in FIG. 1A, more clearly shows the grooves 18 between land portions 20 and reinforcing rings 12 and 14 welded to cylindrical land portions 20 and oblong land portions 22, respectively. Rings 14 provide stability-increasing members connecting the land portions 22 between adjacent grooves 18. Only very small welds should be used to weld the rings 14 in their proper place. This prevents high temperature differences from accruing in the land portions 22 especially close to the screening slots of the grooves 18.

While the size of the "small" welds utilized according to the present invention will vary according to the size of the screen cylinder and material of which it is made, and other factors, for TIG-welding a typical small weld could vary between about 1–3 mm in width, preferably about 2 mm. Fusion welding (resistant-spot-welding) is more difficult to specify dimensionally. However typically the weld should have a width dimension that is at least 75% of the width of the land area 22, and typically almost the entire width of the land area 22, without overlapping to interfere with accepts flow, and typically the length of the small weld would be at least 50% of the width of the ring 14 at the weld.

Figure 3:
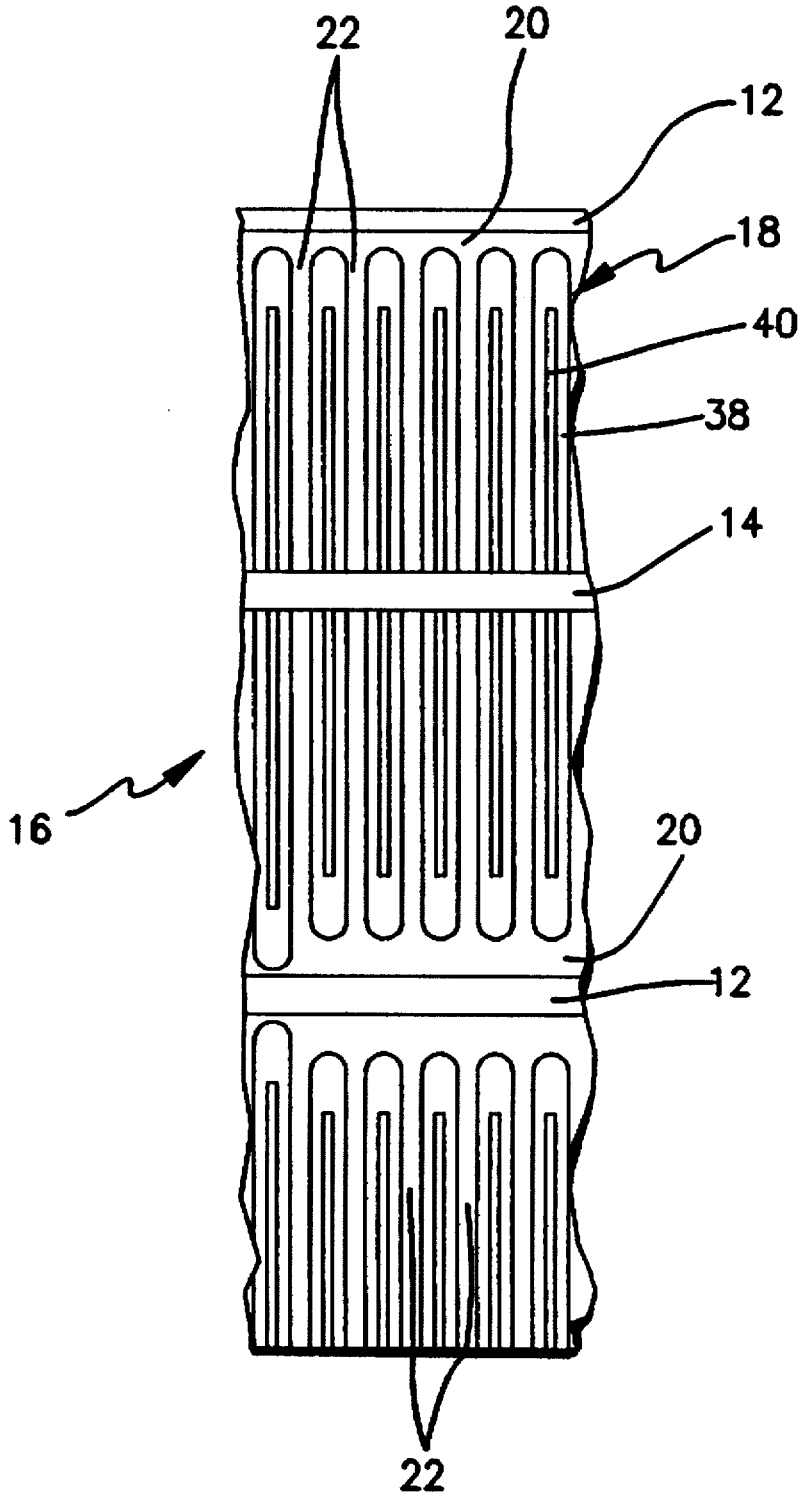
FIG. 3 is an end view of a portion of the outer surface of the screen cylinder of FIGS. 1A and 2 viewed at the arrows 3—3 of FIG. 2.

FIG. 3 shows a fragment of a groove area 16 of FIG. 2 taken at area 3—3 in FIG. 2. FIG. 3 shows rings 12 fastened to the cylindrical land portions 20 between rows of grooves 18 and a ring 14 bridging perpendicularly over several adjacent grooves 18 in the grooved area 16. The grooves 18 each typically include a relief groove 38 and a screening slot 40 [the actual sizing slot] disposed in the bottom of the relief groove 38. The grooves 18 and slots 40 may be made by any suitable manufacturing technique, e.g. by conventional milling, laser cutting, or water jet cutting. In many screen cylinders 10 a slot 40 will be provided in all (or substantially all) of the grooves 18. However cylinders 10 may be constructed in which other openings (e.g. round or oblong holes) may be provided in at least some of the grooves 18 in place of (or in addition to) the slots 40.

Figure 4:
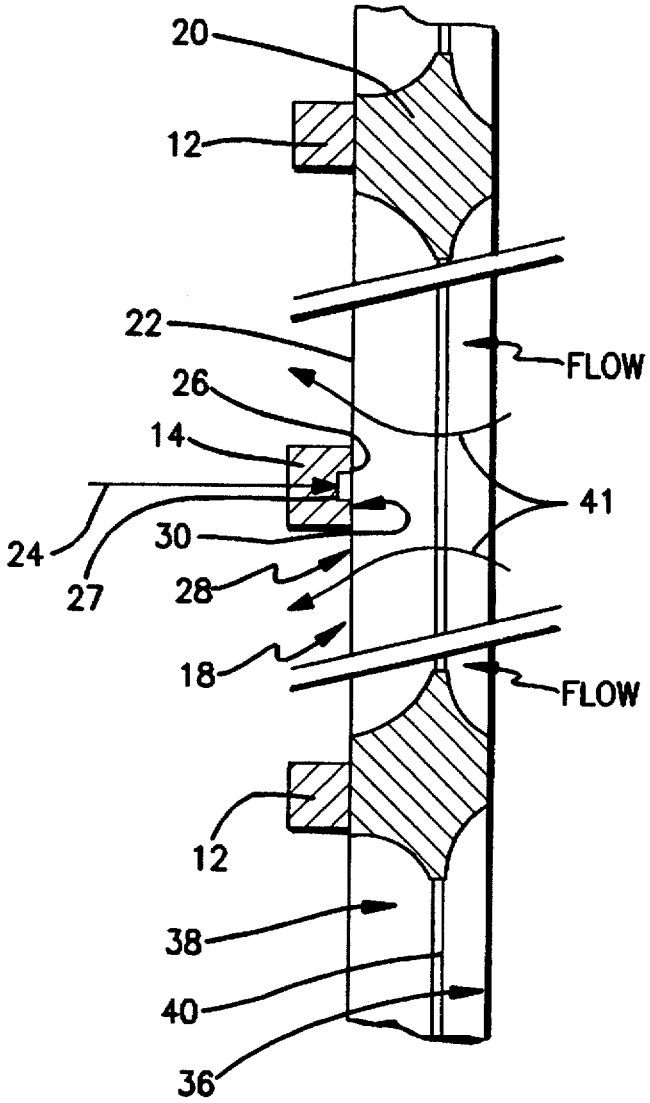
FIG. 4 is an enlarged schematic cross-sectional view of a portion of the screen cylinder of FIG. 2, with arrows showing the direction of flow from inside the screen cylinder to the outside thereof.

FIG. 4 shows in an enlarged portion of the sectional view of the screen cylinder shown in FIG. 2 one way of fastening a reinforcement ring 14 to a land portion 22. The ring 14 is welded by laser 24 welding radially through the ring 14, such that a welded seam 26 is formed between the outer surface 28 of the oblong land portion 22 and the inner cylindrical surface 30 of the ring 14. The welded seam 26, which is rather small (e.g. about 1–3 mm in width) and covered by the ring 14 does not form an obstruction outside (e.g. on the sides of) the ring 14 preventing flow of fiber suspension. The inner cylindrical surface of the ring 14 may have a chamfer for providing a space for the weld 26, a chamfer 27 being shown in FIG. 4 greatly exaggerated in size for clarity of illustration.

A continuous laser welded seam 26 according to a preferred embodiment of the present invention would typically be made continuous along the entire circumference of the ring 14, i.e. also over those areas of the ring 14 bridging over grooves 18 and slots 40. The laser weld 26 formed is very small and does not in any noticeable way protrude (e.g. on the sides of) into the grooves 18 or cause changes in flow conditions of the suspension being screened. The flow of fiber suspension is not significantly adversely affected by the ring 14 or the weld 26 on its inner cylindrical surface. Accepts flow passes from the inlet side of the cylinder—as shown by the arrows in so FIG. 4—through an inlet side contoured groove 36, passes through the screening slot 40, and is discharged through the relief groove 38 on the outlet side of the screening cylinder 10. Any accepts flow portion flowing directly against the ring 14 is automatically deflected around the ring on either side thereof again, as indicated by arrows (41) in FIG. 4.

Figure 5:
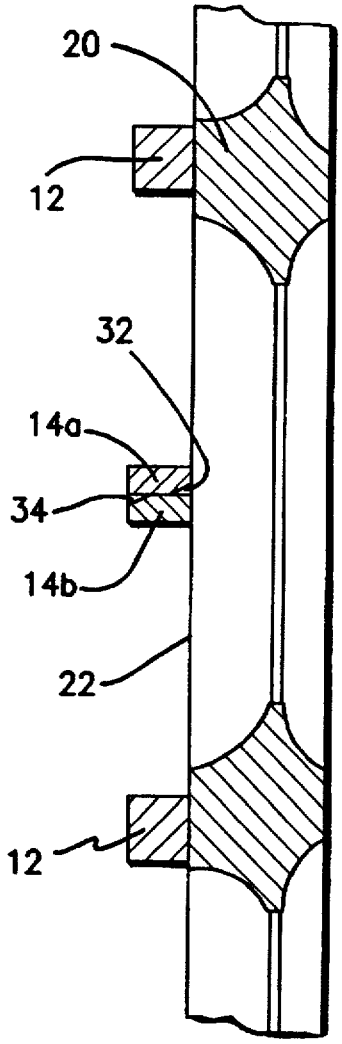

FIG. 5 is an illustration like that of FIG. 4 but showing another preferred, exemplary embodiment of the present invention. Here two rings **14*a* and 14*b* together form a composite reinforcement ting (14). First ring 14*a* is looped on the screen cylinder 10 and welded by a minor weld 32 to the oblong land portion 22. One side of the inner cylindrical plane of the first ring 14*a* is slightly bevelled—as seen in FIG. 5—to provide space for the weld 32. Thereafter a second ring 14*b* is looped onto the screen cylinder 10, such that the second ring 14*b* covers the minor weld 32. One side of the outer cylindrical plane of the second ring 14b is slightly bevelled—as seen in FIG. 5—to provide space for a second minor weld 34. The second minor weld 34 fastens the second ring 14b to the first ring 14a. The welds 32, 34 are well protected and do not protrude on either side of the composite ring 14a, 14b**.

Figure 6:
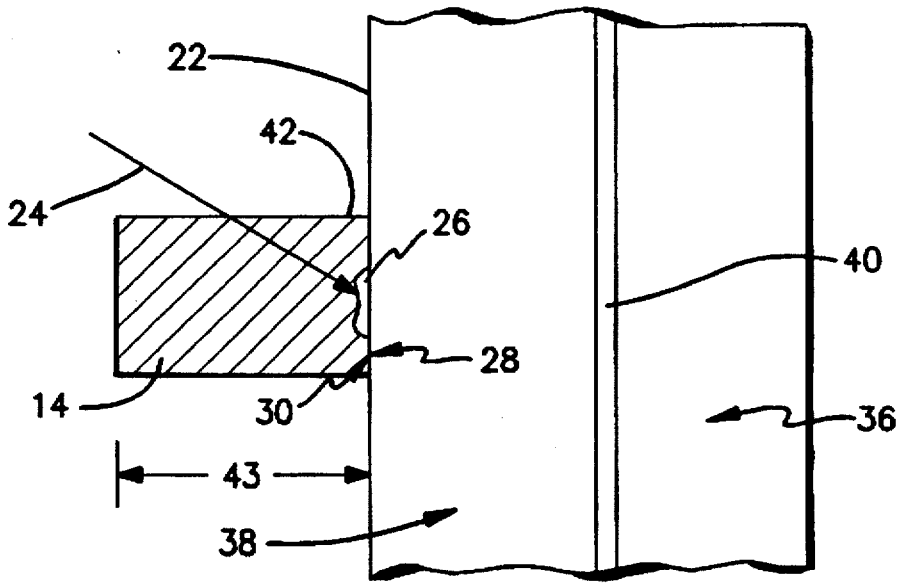

FIG. 6 shows welding of a ring 14 having a radial extension (dimension 43) too large to be welded by radial laser welding through the ring 14. The ring 14 is welded from the side through one radial side plane 42, whereby a laser beam need only penetrate a short portion of the ring 14, and welding can be performed, the weld 26 being formed.

Figure 7:
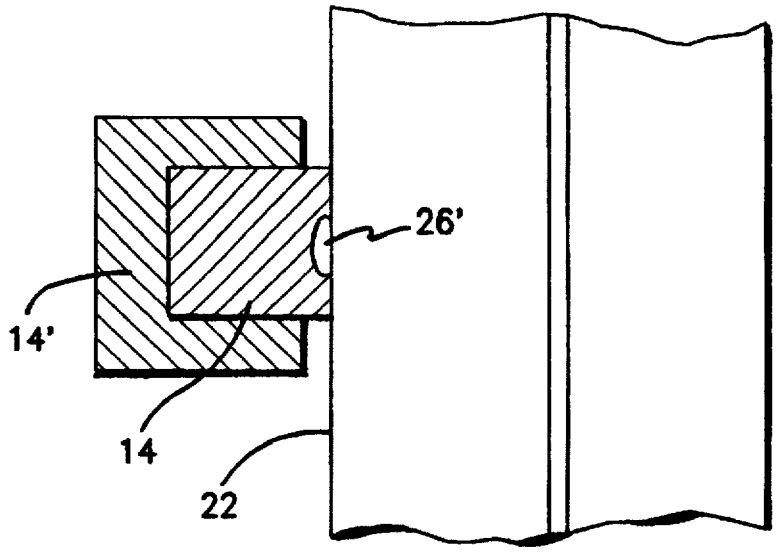

FIG. 7 shows a small ring 14, giving only a limited structural reinforcement to the screen cylinder 10, "gently" spot welded—as indicated at 26'—onto the cylinder 10 without heating or affecting the land portions 22 between adjacent grooves and slots. A second, reinforcement, ring 14' is looped over the small ring 14 (before the ends of each of the rings 14, 14' are welded to each other) to ensure structural stability of the cylinder 10. The reinforcement ring 14' has a U-shaped radial cross section, opening inwardly toward the cylinder 10. The second ring 14' does not have to be welded to the actual screen cylinder 10 itself. The second ring 14' may be welded to the small ring 14, or may not need to be fastened by welding at all (i.e. the U-shaped cross-section of ring 14' may keep the rings 14, 14' in place), as its cylindrical form keeps it tight around the cylinder 10.

Figure 8:
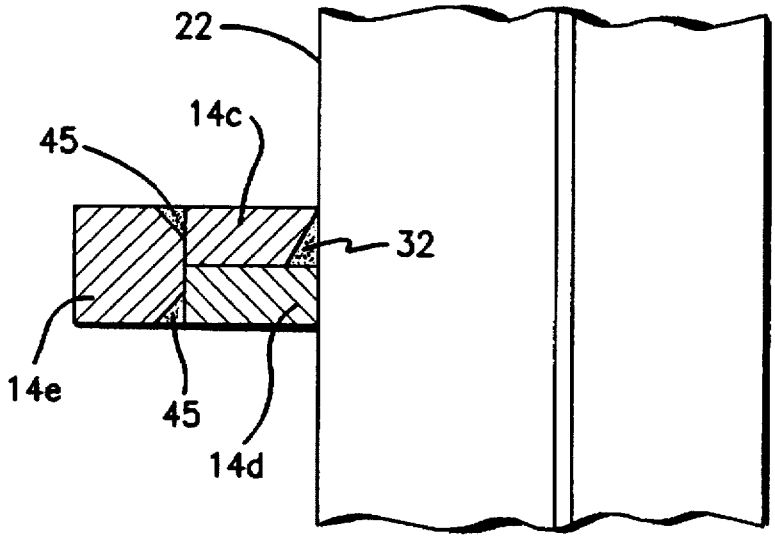
FIGS. 5 through 8 are views like those of FIG. 4 only showing different constructions of second reinforcing rings, and manners of connection thereof, to the screen cylinder.

FIG. 8 shows still another reinforcement ring construction, comprising two small tings 14c and 14d, the ring 14c connected to the land portions 22 between grooves by a weld 32, as shown in FIG. 5. A reinforcement ring 14e is fastened by welding, conventional or laser welding, or electron beam or resistance welding, radially outwardly onto the two small rings 14c, 14d, i.e. by welds 45. The reinforcement ting 14e can be welded to the first rings 14c and 14d without affecting the land portions 22 between the grooves 18 and slots 40 of the cylinder 10.

The present invention provides a screen cylinder 10 in which, due to reinforcement rings 14, etc., welded also adjacent grooved areas, effective slot 40 length can be increased by about 10–80%, typically about 40–70%, compared to conventional screen cylinders. This can be shown in an example comparing effective lengths of slots in a conventional screen having 7 rows of 50 mm/70 mm slots/grooves and a screen according to the present invention having 6 rows of 80 mm/100 mm slots/grooves, the screen having a total axial length of 640 mm. Each relief groove 38 is, if made by conventional milling, about 20 mm longer than the slot 40 and a land area 22 of about 20 mm is present between rows of slots 40. Grooves 18 made by water-jet or laser cutting may have almost the same length on the sizing slot as the relief groove.

Total effective length of slots in a conventional screen, is according to the above example, 7*50 mm=350 mm or 350/640=54,7% of total length. [Effective slot length in conventional screen cylinders is typically only about 45–55% of total screen length.]

Total effective length of slots in a screen according to the present invention is, according to the above example, 6*80 mm: 480 mm or 480/640=75% of total length. The increase of slot length from 50 mm to 80 mm increasing effective length considerably from 54 7% to 75% (i.e. an increase of about 37%). This considerable increase in open area and flow capacity is accomplished without sacrificing cleanliness of the accepts flow since the slot 40 widths remain the same. That is, according to the present invention the sum of the actual lengths of slots 40 in a column of grooves 18 extending axially in a straight line along the cylinder 10 divided by the effective axial length of the cylinder 10 is between about 0.65–0.90 (compared to about 0.45–0.55 in conventional screen cylinders), and preferably this ratio is greater than 0.7 to about 0.8, or about 0.9.

A minor modification of the above example is schematically illustrated in drawing FIGS. 9–12. FIG. 9 shows a typical conventional screen cylinder from the outside 42 and partly opened up from the inside 44. The screen cylinder 10 has 6 rows of circumferential groove areas 16, with slots 40 having a length of 50 mm. Each circumferential land area 20 between two neighboring rows of circumferential groove areas 16 has a considerable axial dimension. Total axial slot length is 300 mm.

A ring 12 having an axial length of 22 mm is fastened by conventional welding, with welds 46, onto every second circumferential land area 20. The land areas 20 have, for stability reasons, an axial length of about twice the axial length of the ring 12 and about the same length as the sizing slot 40, as can be seen in the enlargement (FIG. 10) of the encircled portion of the cross section of the wall 45 of the screen cylinder 10 in FIG. 9.

FIGS. 11 and 12 show a view corresponding to the view in FIGS. 9 and 10 of a screen cylinder according to the present invention, the cylinder having only 5 rows of circumferential groove areas 16, with circumferential land areas 20 therebetween. A composite double ring construction 14a, 14b, similar to the ring construction shown in FIG. 5, is welded according to the present invention onto each land area 20 and also onto each groove area 16 approximately in the middle between each circumferential land area 20. The rings 12 in this embodiment have the same size and construction as the ring 14 (i.e. with parts like 14a, 14b). These latter rings are fastened by laser, electron beam or resistance welding onto the land portions 22 between two neighboring grooves 18. A total of 9 rings are welded onto the cylinder 10 of FIG. 11, which allows the composite rings 14a, 14b to each be much smaller than each of the two rings 12 used in conventional screen cylinder shown in FIGS. 9 and 10.

The circumferential land areas 22 have a very small axial dimension compared to the lengths of the grooves 18 and slots 40, as can be seen in FIG. 12. The slots 40 have a length of 85 mm, providing a total axial slot length of 425 mm. This leads to an approximately 42% larger open area compared to conventional screen cylinders, such as shown in FIG. 9.

Providing more rings 14a, 14b in the screen cylinder decreases the free length of grooves, thereby increasing stability of the screen cylinder considerably. The length of the "unsupported axial ridge" between two adjacent grooves will be shorter than in current conventional cylinders and accordingly add more stability and lessen fatigue causing fluctuations, undesirable movements of land portions between grooves and slots. Thereby also problems with stress risers at the four corners of the slots 40, in cylinders manufactured with conventional milling tools, are minimized. Due to this novel reinforcement ring arrangement, the screen cylinder in FIG. 11 has the same stability as the screen cylinder shown in FIG. 9 even if slot length is increased from 50 mm to 85 mm.

According to the present invention reinforcement rings can be fastened on screen cylinders in a gentle manner, with several gentle welds without negatively affecting the screen construction, i.e. the screening or flow conditions in the screen. Normally rings 14 should be welded to substantially all land areas 22 they traverse, but in some circumstances they may be welded to only some of the land areas 22 (but normally at least a majority).

Figure 13:
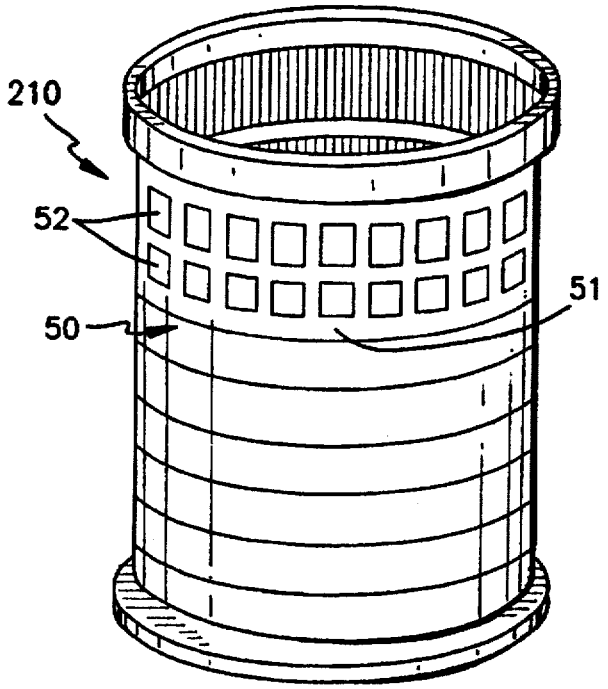
FIG. 13 is a top perspective view of another exemplary embodiment of a screen cylinder according to the invention.
Figure 14:
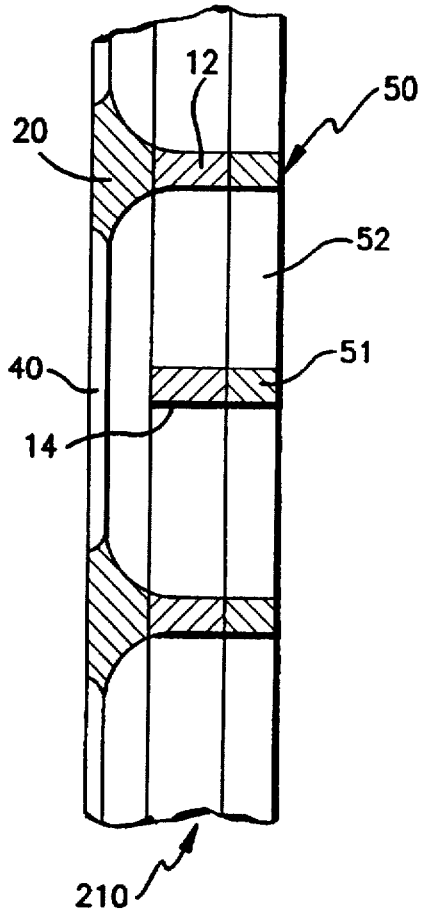
FIG. 14 is a detail cross-sectional view of a portion of the screen cylinder of FIG. 13.

The embodiments described above are best suited for use in screening pulps in the lower consistency range, e. g. between about 0.3–1.5%, and high flow volumes where highly aggressive (high power) rotors actions are not required. However where the pulp consistency is between about 1.5–6.0%, or otherwise where aggressive rotors are used (that is where the power consumption is above about 30 $kW/m^2$ of cylinder surface area), instead of—or preferably in addition to—the rings 12, 14 described above a metal (e.g. steel) backing support cylinder with large [typically square] punched openings can also be provided, e.g. attached to the rings, e.g. by welding. Such an embodiment is illustrated in FIGS. 13 and 14. The screen cylinder 210 has a punched metal (e.g. steel) cylinder 50 which is looped around the rings 12, 14 and is welded, or otherwise attached, thereto. The metal body 51 of the cylinder 50 has a number of large (i.e. at least three times as width as a groove 18, and typically about 5–15 times as wide) openings 52 punched therein, the openings 52 preferably having a square configuration as illustrated in FIG. 13.

While not shown in FIG. 14, instead of the cylinder 50 being looped over the rings 12, 14, the cylinder 50 may be looped over the surface of the cylinder 210 itself, and be welded at the land areas 20 and/or 22.

Figure 15:
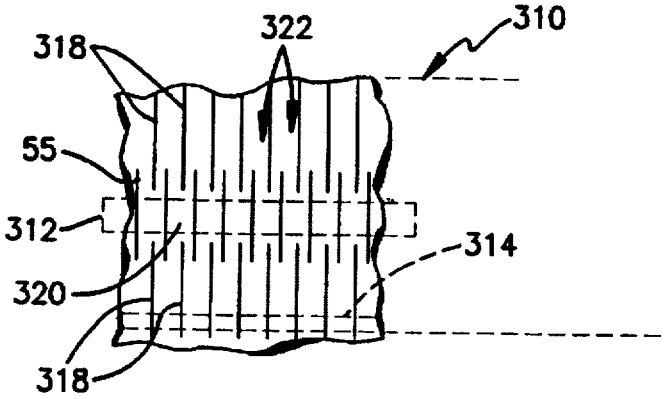
FIG. 15 is a schematic view like that of FIG. 3 only showing a screen cylinder surface configuration that contains staggered slot rows.

In some screen cylinders (having staggered slot rows), the circumferential solid land areas (20) are interrupted by grooves (with slots) which bridge them, and are staggered between the normal rows of grooves and slots. In such cylinders the first and second rings used are essentially the same as in the conventional constructions, and have substantially the same spacings between them, the first rings merely have the welds thereof interrupted by the staggered, bridging, grooves. Such an embodiment is seen schematically in FIG. 15. In this embodiment elements are shown by the same reference numerals as in the FIGS. 1–3 embodiment, only preceded by a "3". The cylinder 310 surface has, in addition to the grooves 318 (with slots therein, not shown in FIG. 15 because of the schematic nature of the drawing), grooves 55 (with slots therein) which bridge the otherwise circumferential land areas 320, the grooves 55 staggered with respect to the grooves 318. In this configuration the rings 312, 314 are welded to the land areas 320, 322, and are spaced from each other in substantially the same way, and with the same spacing between them, as are the rings 12, 14 in 30 the FIGS. 1–3 embodiment.

While the invention has been described in connection with what is presently considered to be the most practical and preferred embodiments, it is to be understood that the invention is not to be limited to the enclosed embodiments, but on the contrary, is intended to cover various modifications and equivalent arrangements included within the spirit and scope of the appended claims. For example, while the screen cylinders actually illustrated have all been out-flow type screen cylinders, with the accept flow flowing from the inside of the cylinder to the outside thereof, and reinforcement rings being fastened on the outside of the cylinder, rings can similarly or alternatively be fastened on the inner side of the cylinder in an inflow type of screen cylinder, with accepts flow flowing from the outside of the cylinder to the inside thereof. Also, while in the different types of welds according to the present invention shown in FIGS. 4–8 all the welds are more or less covered by a ring 14, it is possible to weld a ring along the edges of its inner cylindrical surface, such that the welds remain uncovered by the ring itself. In this case, the welding has to be made with laser or electron beam with an absolute minimum of energy at which heat effect for welding still can be attained to prevent stresses caused by shrinkage.

While the invention has been described with respect to welding, which is in the preferred embodiment, it is to be to be understood that attachment—particularly of the rings 14—may be accomplished by other mechanisms in the future if suitable adhesives, brazing, or soldering techniques, or the like, are developed.

The claims are to be accorded the broadest interpretation thereof so as to encompass all equivalent structures, systems, and methods.

What is claimed is:

1. A screen cylinder for screening suspensions to provide an accepts portion and a rejects portion, said screen cylinder comprising:

a cylinder having an outer surface, an inner surface, a central axis, and an effective axial length, one of said inner and outer surfaces comprising an outlet side of said cylinder, and the other of said inner and outer surfaces comprising an inlet side of said cylinder;

a plurality of grooves substantially parallel to said central axis formed in said outlet surface, disposed in a plurality of rows with a plurality of parallel grooves disposed, in sequence, in each row;

a slot provided in at least some of said grooves, defining a through-extending flow path of a predetermined size between said inlet and outlet surfaces;

at least some of said plurality of rows separated from each other by a first substantially cylindrical land area;

said grooves within a row being separated from each other at said outlet surface by a second land area much smaller than said first land area;

at least one first reinforcing ring fastened to a said first land area for providing stability to said cylinder; and at least one second reinforcing ring permanently fastened to at least a majority of said second land areas in at least one row of grooves to provide additional stability to said cylinder without significantly adversely affecting the flow of accepts through said slots.

2. A screen cylinder as recited in claim 1 wherein said at least one second reinforcing ring is fastened to substantially all of said second land areas in one row of grooves by a first weld between said second reinforcing ring and substantially each of said second land areas.

3. A screen cylinder as recited in claim 2 wherein each of said first welds has a width of about 1–3 mm.

4. A screen cylinder as recited in claim 3 wherein the sum of the axial lengths of slots in a column of grooves extending axially in a straight line along said cylinder divided by said effective axial length of said cylinder is between about 0.65–0.90.

5. A screen cylinder as recited in claim 2 wherein the sum of the axial lengths of slots in a column of grooves extending axially in a straight line along said cylinder divided by said effective axial length of said cylinder is greater than 0.7 to about 0.8.

6. A screen cylinder as recited in claim 2 wherein said at least one second reinforcing ring comprises a composite ring formed of axially spaced first and second components welded to each other.

7. A screen cylinder as recited in claim 2 wherein said plurality of grooves comprises a first set of grooves; and wherein said first substantially cylindrical land area is interrupted and bridged by a second set of grooves staggered with respect to said first set of grooves.

8. A screen cylinder as recited in claim 1 further comprising a punched cylinder disposed over, and connected to, said first and second reinforcing rings, providing further reinforcement to said cylinder.

9. A screen cylinder as recited in claim 8 wherein said punched cylinder comprises substantially square punched openings each having a width at least about three times as great as the width of a said groove.

10. A screen cylinder as recited in claim 1 wherein the sum of the axial lengths of slots in a column of grooves extending axially in a straight line along said cylinder divided by said effective axial length of said cylinder is greater than 0.7 to about 0.8.

11. A screen cylinder as recited in claim 1 wherein at least one second reinforcing ring is connected to at least some of said second land areas in one of said rows of grooves by laser or electric beam spot or continuous welds.

12. A screen cylinder as recited in claim 1 wherein said inner surface comprises the inlet side of said cylinder, said inner surface including contoured grooves corresponding to said slots; and wherein said grooves in said outlet side comprise relief grooves.

13. A screen cylinder as recited in claim 1 wherein said plurality of rows of grooves comprises 4–10 circumferential rows of grooves; and wherein said at least one second reinforcing ring comprises at least two second reinforcing rings associated with different rows of grooves.

14. A screen cylinder as recited in claim 1 wherein said at least one second reinforcing ring comprises a composite ring formed of axially spaced first and second components welded to each other.

15. A screen cylinder as recited in claim 1 wherein said at least one second reinforcing ring comprises a composite ring formed of radially spaced first and second components connected together.

16. A screen cylinder as recited in claim 1 wherein said plurality of grooves comprises a first set of grooves; and wherein said first substantially cylindrical land area is interrupted and bridged by a second set of grooves staggered with respect to said first set of grooves.

17. A screen cylinder for screening suspensions to provide an accepts portion and a rejects portion, said screen cylinder comprising:

a cylinder having an outer surface, an inner surface, a central axis, and an effective axial length, one of said inner and outer surfaces comprising an outlet side of said cylinder, and the other of said inner and outer surfaces comprising an inlet side of said cylinder;

a plurality of grooves substantially parallel to said central axis formed in said outlet surface, disposed in a plurality of rows with a plurality of parallel grooves disposed, in sequence, in each row;

a slot provided in at least some of said grooves, defining a through-extending flow path of a predetermined size between said inlet and outlet surfaces;

at least some of said plurality of rows separated from each other by a first substantially cylindrical land area;

said grooves within a row being separated from each other at said outlet surface by a second land area much smaller than said first land area;

at least one reinforcing ring permanently fastened to at least a majority of said second land areas in at least one row of grooves to provide stability to said cylinder without significantly adversely affecting the flow of accepts through said slots; and wherein the sum of the axial lengths of slots in a column of grooves extending axially in a straight line along said cylinder divided by said effective axial length of said cylinder is greater than 0.7 to about 0.8.

18. A screen cylinder as recited in claim 17 wherein said at least one reinforcing ring comprises a first reinforcing ring, and further comprising at least one second reinforcing ring fastened to a said first land area for providing stability to said cylinder.

19. A screen cylinder for screening suspensions to provide an accepts portion and a rejects portion, said screen cylinder comprising:

a cylinder having an outer surface, an inner surface, a central axis, and an effective axial length, one of said inner and outer surfaces comprising an outlet side of said cylinder, and the other of said inner and outer surfaces comprising an inlet side of said cylinder;

a plurality of grooves substantially parallel to said central axis formed in said outlet surface, disposed in a plurality of rows with a plurality of parallel grooves disposed, in sequence, in each row;

a slot provided in at least some of said grooves, defining a through-extending flow path of a predetermined size between said inlet and outlet surfaces;

at least some of said plurality of rows separated from each other by a first substantially cylindrical land area;

said grooves within a row being separated from each other at said outlet surface by a second land area much smaller than said first land area;

at least one reinforcing ring permanently fastened to at least a majority of said second land areas in at least one row of grooves to provide stability to said cylinder without significantly adversely affecting the flow of accepts through said slots; and wherein said at least one second reinforcing ring comprises a composite ring formed of axially spaced first and second components welded to each other.

20. A screen cylinder as recited in claim 19 wherein said at least one reinforcing ring comprises a first reinforcing ring, and further comprising at least one second reinforcing ring fastened to a said first land area for providing stability to said cylinder.

21. A screen cylinder for screening suspensions to provide an accepts portion and a rejects portion, said screen cylinder comprising:

a cylinder having an outer surface, an inner surface, a central axis, and an effective axial length, one of said inner and outer surfaces comprising an outlet side of said cylinder, and the other of said inner and outer surfaces comprising an inlet side of said cylinder;

a plurality of grooves substantially parallel to said central axis formed in said outlet surface, disposed in a plurality of rows with a plurality of parallel grooves disposed, in sequence, in each row;

a slot provided in at least some of said grooves, defining a through-extending flow path of a predetermined size between said inlet and outlet surfaces;

at least some of said plurality of rows separated from each other by a first substantially cylindrical land area;

said grooves within a row being separated from each other at said outlet surface by a second land area much smaller than said first land area;

at least one reinforcing ring permanently fastened to at least a majority of said second land areas in at least one row of grooves to provide stability to said cylinder without significantly adversely affecting the flow of accepts through said slots; and wherein said plurality of grooves comprises a first set of grooves; and wherein said first substantially cylindrical land area is interrupted and bridged by a second set of grooves staggered with respect to said first set of grooves.

22. A screen cylinder as recited in claim 21 wherein said at least one reinforcing ring comprises a first reinforcing ring, and further comprising at least one second reinforcing ring fastened to a said first land area for providing stability to said cylinder.

23. A screen cylinder for screening suspensions to provide an accepts portion and a rejects portion, said screen cylinder comprising:

a cylinder having an outer surface, an inner surface, a central axis, and an effective axial length, one of said inner and outer surfaces comprising an outlet side of said cylinder, and the other of said inner and outer surfaces comprising an inlet side of said cylinder;

a plurality of grooves substantially parallel to said central axis formed in said outlet surface, disposed in a plurality of rows with a plurality of parallel grooves disposed, in sequence, in each row;

a slot provided in at least some of said grooves, defining a through-extending flow path of a predetermined size between said inlet and outlet surfaces;

said grooves within a row, and said rows of grooves, being separated from each other at said outlet surface by land areas; and at least one reinforcing ring permanently fastened to at least a majority of said land areas in at least one row of grooves to provide stability to said cylinder without significantly adversely affecting the flow of accepts through said slots, said at least one ring comprising a composite ring formed of distinct components connected together.

24. A screen cylinder as recited in claim 23 wherein said at least one second reinforcing ring comprises a composite ring formed of axially spaced first and second components welded to each other.

25. A screen cylinder as recited in claim 23 wherein said at least one second reinforcing ring comprises a composite ring formed of radially spaced first and second components connected together.

* * * * *